United States Patent [19]

Litman

[11] 3,956,843

[45] May 18, 1976

[54] DUAL RANGE PROJECTILE AND LAUNCHING DEVICE AND DISPOSABLE LAUNCHING TUBE ASSEMBLY THEREFOR

[75] Inventor: Alan Litman, Pittsburgh, Pa.

[73] Assignee: Smith & Wesson Chemical Company, Inc., Rock Creek, Ohio

[22] Filed: Mar. 13, 1975

[21] Appl. No.: 558,042

[52] U.S. Cl. ..... 42/1 F; 42/1 G; 42/1 MH

[51] Int. Cl.[2] ..... F41C 27/06

[58] Field of Search ..... 42/1 F, 1 G, 1 H, 1 Z; 102/65, 2

[56] References Cited

UNITED STATES PATENTS

| | | | |
|---|---|---|---|
| 1,663,834 | 3/1928 | Goss | 42/1 G |
| 1,897,992 | 2/1933 | Ailes | 42/1 G |
| 3,243,909 | 4/1966 | Kotikov | 42/1 F |
| 3,315,397 | 4/1967 | Gilliam et al. | 42/1 Z |
| 3,820,462 | 6/1974 | Jackson, Jr. | 42/1 Z |

*Primary Examiner*—Charles T. Jordan
*Attorney, Agent, or Firm*—Patrick J. Walsh

[57] ABSTRACT

A launching tube accommodating a projectile and a propellant charge containing percussion cap or primer is mounted on a handle; releasably retained in position by magnetic means or a mechanical detent. The handle contains a spring powered firing pin adapted to strike the percussion cap, igniting the propellant charge to launch the projectile. The launching tube is provided with one or more gas vent ports which are normally covered by pressure sensitive tape for long range launchings. Removal of the tape vents a portion of the propellant gases for short range launchings. The firing pin is permitted a limited degree of over travel beyond the point of impact with the precussion cap or primer to absorb recoil and to automatically eject the launching tube.

6 Claims, 10 Drawing Figures

12
14
16
46
56
64
66
68

DUAL RANGE PROJECTILE AND LAUNCHING DEVICE AND DISPOSABLE LAUNCHING TUBE ASSEMBLY THEREFOR

BACKGROUND AND OBJECTS OF THE INVENTION

The present invention relates to hand-held, self-launching projectile devices. Such prior art devices have typically not been conducive to rapid fire operation and are not particularly susceptible to varied range accuracy. Heretofore, the range of projectile flight was varied by selectively adjusting the elevation of the projectile launching tube and thus the trajectory of ballistic flight. This requires considerable skill and training on the part of the individual manipulating the launching tube. For short range flights the projectile has to be fired high into the air so that a greater proportion of the typically constant propellant charge is dissipated in achieving projectile height rather than distance. Under these circumstances a difference in several degrees of launch elevation can result in a considerably variation in projectile range.

Mob control unfortunately has become an increasingly important function of police and civil defense forces. One of the most important tools used by authorities for control of mobs is irritant gases, such as tear gas, which can be extremely effective as dispersal agents. Tear gas projectiles are thrown and, when greater range is desired, projected from launchers. Obviously, it is important that the tear gas projectile land reasonably on target in the midst of a mob. If the projectile overshoots the target, innocent bystanders may be subjected to the irritant dispensed by the projectile. If the projectile falls short of the target, the desired mob dispersal effect will also not be achieved. Naturally, it is most desirable to disperse an unruly mob before it gets within close range of the authorities to avert physical contact. Thus, it is desirable to provide the authorities with self-launching irritant gas projectile launching devices which are susceptible of accurate, long range use. However, if the mob is not sufficiently dispersed and surges closer, it is also desirable to provide launching devices with a comparatively lower energy and velocity which can be used effectively at ranges just beyond throwing range.

It is accordingly an object of the present invention to provide a dual range, projectile launching device which is readily convertible from long range to short range operation.

Still another object of the invention is to provide a projectile launching device of the above character which is susceptible to accurate operation by personnel having only a minimum amount of training in the use thereof. A further launching is to provide a projectile lanching device of the above character which is susceptible to rapid fire operation.

An additional object is to provide a projectile launching device of the above character having a launching tube pre-loaded with a projectile and launch propellant; the launching tube being ejected and discarded after launch.

Yet another object of the invention is to provide a projectile launching device of the above character which is simple in design and inexpensive to manufacture.

Other objects of the invention will in part be obvious and in part appear hereinafter.

In accordance with the present invention, there is provided a disposable launching tube which is preloaded, typically at the factory, with a projectile and a percussion cap or primer containing a launch propellant charge. The launching tube is mounted on a launching handle, and a permanent magnet carried by the launching handle provides a magnetic means or a mechanical detent for releasably retaining the launching tube in place until after launch. The launching handle contains a firing pin, which is propelled by a spring into striking engagement with the percussion cap or primer to initiate projectile launch.

The launching tube is further provided with one or more vent ports which are normally covered by one or more wraps of a filament reinforced or other suitable pressure sensitive tape. If these vent ports remain covered by the tape at launch, the launch propellant gases released by the percussion cap are not vented through these ports, thereby providing for long range projectile flight.

On the other hand, for close in, short range use, the tape is removed to open the vent ports. As a consequence, on launch a portion of the launch propellant gases are vented through the ports to proportionately reduce the launching force exerted on the projectile.

The firing pin carried by the launching handle is adapted for a degree of overrun beyond the point where its tip strikes the percussion cap or primer. As a consequence, the firing pin spring acts to overcome the retaining force of the magnetic means or mechanical detent, thereby ejecting the disposable launching tube from the launching handle after the projectile has cleared the launching tube. Coincidentally, the firing pin spring serves coupled with the moving mass of the firing pin to absorb a substantial portion of the launch recoil.

While the present invention is primarily concerned with a launching device for projectiles containing dispersal agents such as tear gas, it will be understood that the launching device of the present invention is equally adaptable to launching other types of projectiles, such as those used for signaling and display purposes.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings, in which.

Like reference numerals refer to corresponding parts throughout the several views of the drawings.

DETAILED DESCRIPTION

Figures 1, 2, 3, 4:
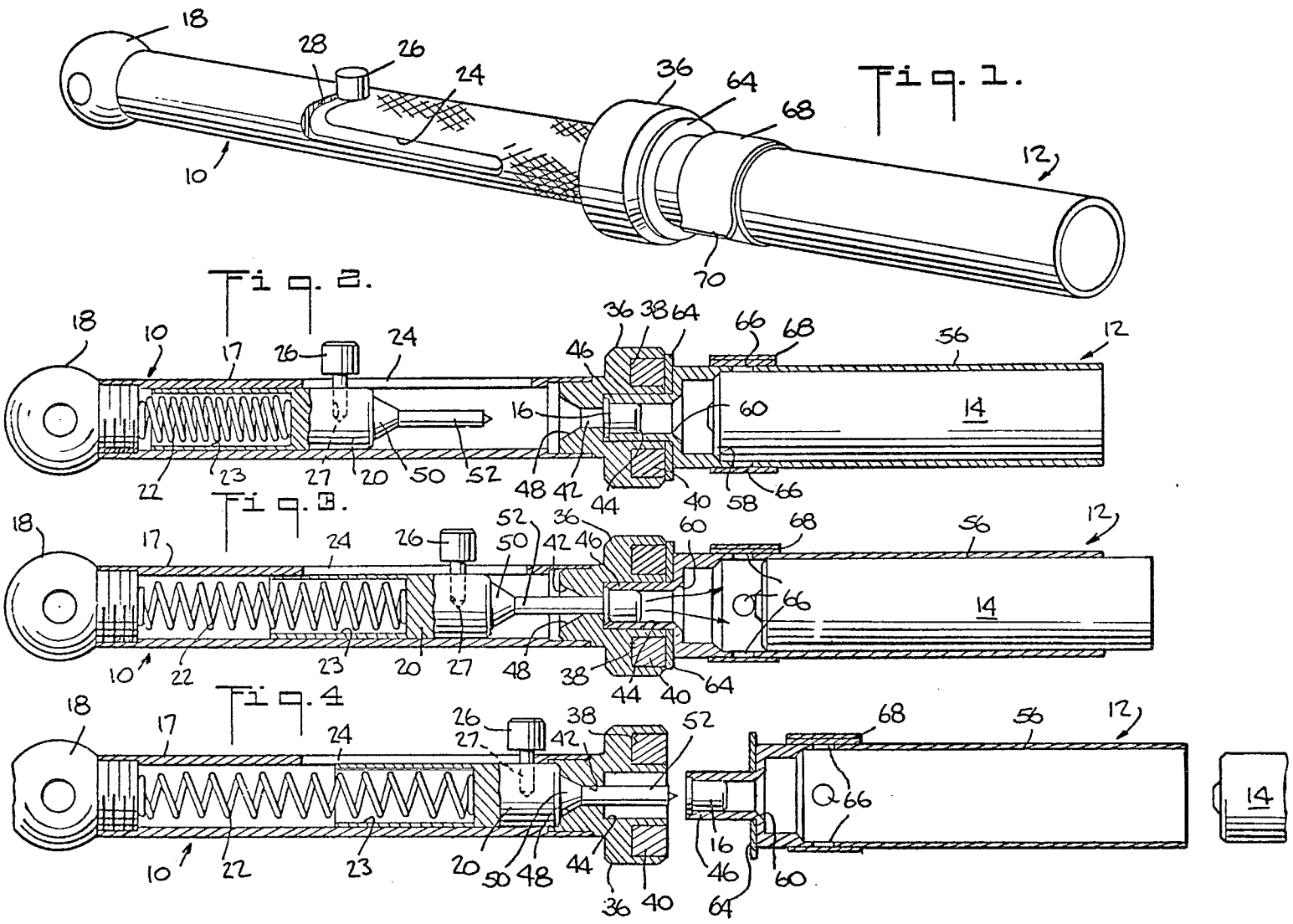
FIG. 1 is a perspective view of a projectile launching device constructed according to a preferred embodiment of the invention.
FIG. 2 is a longitudinal sectional view of the projectile launching device of FIG. 1.
FIG. 3 is a longitudinal sectional view of the projectile launching device at the moment of launch.
FIG. 4 is a longitudinal sectional view of the launching device shortly after launch and illustrates the ejection of the projectile launching tube from the launching handle.

The projectile launching device of the present invention, as seen in FIGS. 1 through 4, comprises a launching handle, generally indicated at 10, and a disposable launching tube, generally indicated at 12, accommodating a projectile 14 and a primer or percussion cap 16. The launching handle comprises a tubular member 17 which is internally threaded at is left end to receive a threaded ball cap 18. The tubular member 17 accommodates a firing pin 20 and a helical spring 22 which is received in a cylindrical recess 23 in the firing pin and acts against the body of the firing pin and ball cap 18. A longitudinal slot 24 is formed in the tubular member 17 of handle 10 and accommodates the shank of a cocking pin 26 threaded into a lateral tapped bore 27 in the firing pin body. The left end of slot 24 is formed having a lateral cocking notch 28. To cock the launching device of the present invention, the cocking pin is pulled rearwardly towards the ball cap end of the launching handle 10 to retract the firing pin 20 against the force of spring 22. When the cocking pin reaches the end of slot 24, it is pushed into the cocking notch 28 to retain the firing pin in a cocked condition. To release the firing pin 20, the cocking pin 26 is pushed out of the cocking notch 28; the firing pin rotating as well as sliding freely within tubular member 17. Once the cocking pin 26 arrives at the junction of notch 28 and slot 24, the firing pin 28 is freed to spring to the right under the force of spring 22.

The right end of launching handle 10 is fitted with a retainer member 36, whose right end face is formed having an annular recess 38 for accommodating a permanent magnet 40. The retainer member 36 is further provided with a central bore 42 which is counterbored at 44 to accommodate the reduced diameter base 46 of the launching tube 12, when the latter is mounted on the launching handle 10. The other end of bore 42 is formed having a conical counterbore 48 which conforms to the conical base 50 of an elongated striker element 52 carried by firing pin 20. The central bore 42 through retainer member 36 is dimensioned such as to accommodate extension of the striker element 52 therethrough.

Still referring to FIGS. 1 through 4, the launching tube 12 comprises a tubular member 56 which terminates in the reduced diameter base 46 accommodated in the counterbore 44 of retainer 36. The tubular member 56 is formed having an internal annular shoulder 58 which serves as a seat for positionally locating the projectile 14 within the launching tube 12. The base 46 communicates with the interior of tubular member 56 through opening 60 and accommodates the percussion cap 16 containing the launch propellent for projectile 14.

In the event the launching tube 12 is made of a nonferrous material such as aluminum or even plastic, a ferrous metal washer is force fitted or otherwise secured on the base 46 of launching tube 12 and thus is in a position to be magnetically attracted by the permanent magnet 40 when the launching tube is mounted on the retainer 36 carried by the launching handle 10. If the launching tube 12 is made of a ferrous material, the washer 64 is unnecessary.

Still referring to FIGS. 1 through 4, the launching tube 12 is formed having a series of lateral vent ports 66 positioned just to the right of annular shoulder 58. Normally, the vent ports 66 are covered by a wrapping of pressure sensitive tape 68, preferably reinforced with fiberglass or nylon filament. The outer end of the tape 68 terminates in a tab 70 (FIG. 1) which can be readily grasped to unwrap the tape 68 and open vent ports 66. As will be seen, when the tape 68 covers the vent ports 66, the launching device of the invention is adapted for long range operation. However, when the tape wrapping 68 is removed, the gas ports 66 are opened to vent a portion of the launch propelling gases generating by the propellant charge in the percussion cap 16 to diminish the range of projectile 14.

In the operation of the projectile launching device of the present invention, the cocking pin 26 is moved into cocking notch 28 to retain the firing pin 20 in its cocked position. The launching tube 12, complete with projectile 14, percussion cap 16 and the tape wrapping 68 covering the vents ports 66, is mounted on the launching handle 10. The permanent magnet 40 by virtue of its magnetic attraction with washer 64 secured on the base of 46 of launching tube 12 maintains the launching tube in its mounted position. To launch the projectile for long range flight, the cocking pin 26 is pushed out of the cocking notch 28 into the longitudinal slot 24 in the handle 10 to release the firing pin 20 for rapid movement to the right under the force of the firing pin spring 22. The pointed tip of the striker element 52 passes through the bore 42 in retainer member 36 and into striking engagement with the percussion cap 16. The percussion cap fires to ignite its propellent charge, releasing the propellent gases to forcibly launch the projectile 14 out of the launching tube 12. Typically, the hot propellent gases also serve to ignite a fuse in the projectile; the fuse, in turn, effecting delayed ignition of a pyrotechnic mixture operative to release the dispersal agent as the projectile lands.

It is seen from FIG. 3 that the conical base 50 of the striker element 52 has not reached the conical counterbore 48 in the retainer member 36 when the tip of the striker element 52 hits the percussion cap 16 to fire the propellant charge. Thus, as seen in FIG. 4, as the projectile 14 clears the launching tube 12 the firing pin continues to advance to the right under the force of its spring 22. The striker element thus pushes against the percussion cap 16 with sufficient force to overcome the magnetic attraction of permanent magnet 40 with washer 64 to dismount and eject the launching tube 12 from the launching handle 10. This over travel of the firing pin 20, in addition to effecting automatic ejection of the launching tube 12 immediately after launch, also serves to dissipate a large portion of the launch recoil in the firing pin spring 22.

It will be appreciated that the automatic ejection of the launching tube immediately upon launching of the projectile readies the launch handle 10 for acceptance of another launching tube assembly 12, and thus the projectile launching device of the present invention is readily adapted to a number of launchings in rapid succession.

FIGS. 5 through 10 depict the positions of the projectile 14 within launching tube 12 before and after launch and also the action of the launch propelling gases on the projectile with the vent ports 66 covered by the tape wrap 68.

Figures 5, 6, 7, 8, 9, 10:
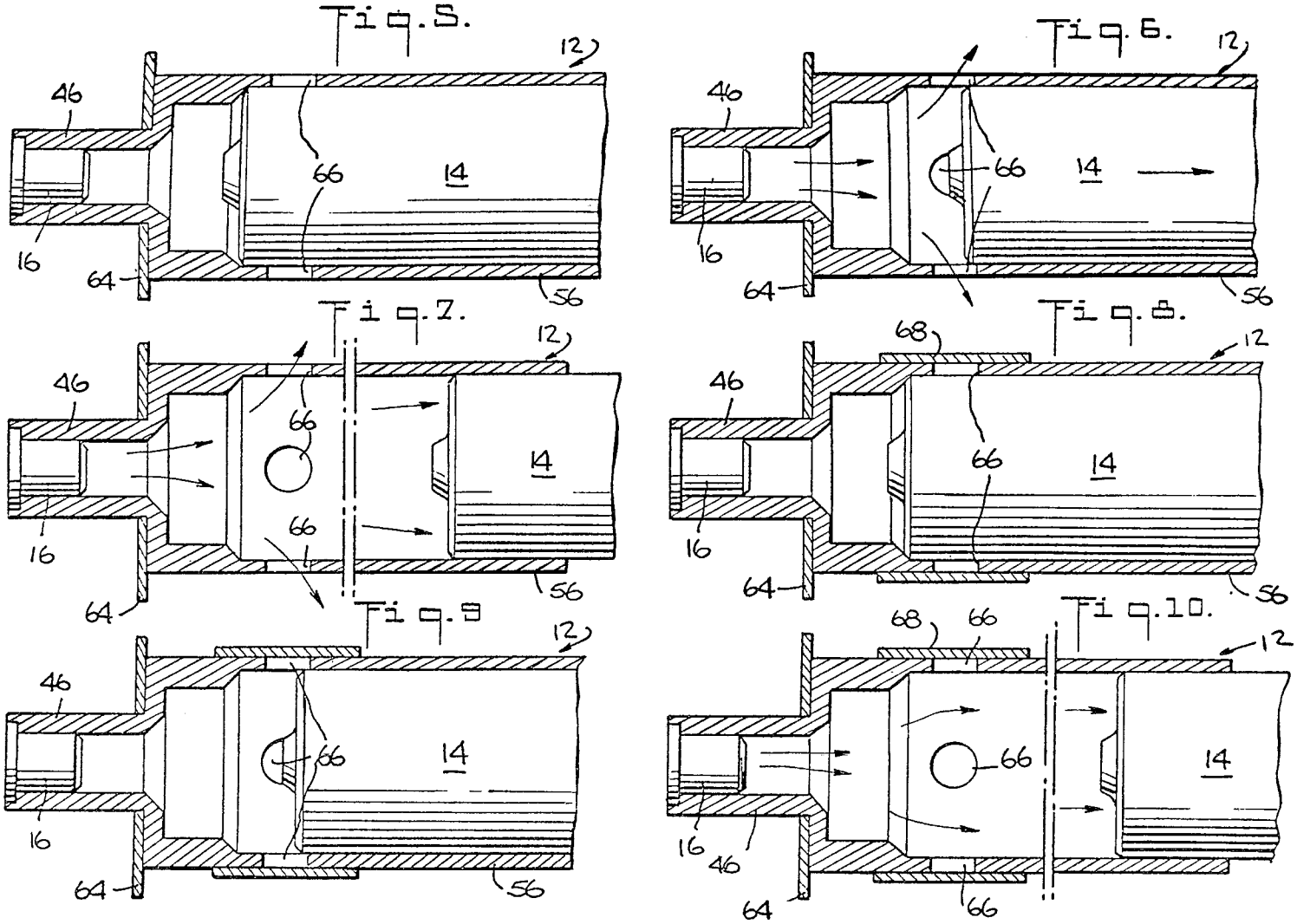
FIG. 5 is an enlarged, fragmentary longitudinal sectional view of the launching tube and projectile prior to launch.
FIG. 6 is an enlarged, fragmentary longitudinal sectional view of the launching tube and projectile of FIG. 5 an instant after launch initiation and illustrates the manner in which the launch propellant gases vented through exposed lateral vent ports in the launching tube.
FIG. 7 is an enlarged, fragmentary longitudinal sectional view of the launching tube of FIG. 5 as the projectile clears the open end of the launching tube.
FIG. 8 is an enlarged, fragmentary longitudinal sectional view of the launching tube and projectile prior to launch with the lateral vent ports covered by a wrap of pressure sensitive tape.
FIG. 9 is an enlarged, fragmentary longitudinal sectional view of the launching tube and projectile of FIG. 8 an instant after the initiation of launch.
FIG. 10 is an enlarged, fragmentary longitudinal sectional view of the launching tube of FIG. 8 as the projectile clears the open end of the launching tube.

For short range launching, the tape wrapping 68 is readily removed to expose ports 66 so as to vent a portion of the launch propelling gases out the side of the launching tube 12, thus automatically reducing the projectile range. The positions on the projectile 14 within the launching tube 12 before and immediately after launch with the vent ports 66 open are depicted in FIGS. 5 through 7.

It will be appreciated that the launching tube length, propellent charge and vent port size and number may be varied to provide a desired ratio of long versus short range. For riot control, a long range of 100 yards and a short range of 100 feet would probably be optimum. It will also be appreciated that the tape may be only partially unwrapped to expose less than all of the vent ports 66 for operation at ranges intermediate the long and short range limits.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. A device for launching a projectile comprising a launching tube, a projectile within the tube, a launching handle, a firing pin mounted for axial movement within the launching handle, a spring in the launching handle cooperating with the firing pin for biasing the firing pin in an axial direction along said launching handle, means for compressing the spring and for retaining the firing pin in a ready position under the force of the spring, said launching handle further including a retainer member mounted on one end thereof, said retainer member having a recess therein for receiving the launching tube, a magnet mounted on the retainer member, said launching tube having a ferrous metal member mounted on its base cooperating with said magnet for detachably retaining the launching tube on the retainer member, said launching tube including a firing cap, an axial bore in the retainer member providing access to the firing cap by the firing pin, said firing pin for entering the retainer member recess to eject the launching tube from the handle, said spring having sufficient force under compression to move the firing pin for detonating said cap to launch the projectile and to enable the firing pin to overcome the magnetic force for ejecting the tube from the retainer member and to absorb at least a portion of the launch recoil.

2. The device defined in claim 1 in which said firing pin means comprises a cocking pin mounted on the firing pin retaining and projecting through a slot in said tubular member and further in which said slot terminates in a notch for receiving the cocking pin to hold the firing pin in ready position.

3. A device as recited in claim 1 in which said launching tube includes a base portion accommodated in said retainer member recess.

4. A device as recited in claim 3 in which the firing cap is located in the base portion of the launching tube in communication with the firing pin.

5. A launching device as recited in claim 1 in which the launching tube is provided with vent means for partially exhausting propulsion gases thereby to reduce the range of the projectile.

6. A device as recited in claim 5 in which the vent means is covered by removable pressure sensitive tape.

* * * * *